US006241576B1

(12) United States Patent
Höfer

(10) Patent No.: US 6,241,576 B1
(45) Date of Patent: Jun. 5, 2001

(54) SHAPING FRAME

(75) Inventor: Ulrich Höfer, Eislingen (DE)

(73) Assignee: Wilh, Wissner GmbH & Co., Kommandit-Gesellschaft, Goppingen (DE)

( * ) Notice: Subject to any disclaimer, the term of this patent is extended or adjusted under 35 U.S.C. 154(b) by 0 days.

(21) Appl. No.: 09/509,103

(22) PCT Filed: Sep. 24, 1998

(86) PCT No.: PCT/EP98/06084

§ 371 Date: Mar. 21, 2000

§ 102(e) Date: Mar. 21, 2000

(87) PCT Pub. No.: WO99/16323

PCT Pub. Date: Apr. 8, 1999

(30) Foreign Application Priority Data

Oct. 1, 1997 (DE) ..... 197 43 501
Oct. 2, 1997 (DE) ..... 197 43 684

(51) Int. Cl.[7] ..... A41C 3/00
(52) U.S. Cl. ..... 450/41
(58) Field of Search ..... 450/48, 41, 42, 450/43, 44, 45, 46, 47, 49, 50, 51, 52

(56) References Cited

U.S. PATENT DOCUMENTS

| | | | | |
|---|---|---|---|---|
| Re. 22,771 | * | 7/1946 | Licht | 2/42 |
| 1,664,926 | | 4/1928 | Imershein et al. . | |
| 2,380,978 | | 8/1945 | Licht . | |
| 2,432,910 | * | 12/1947 | Licht | 2/42 |
| 2,438,062 | * | 3/1948 | Licht | 2/67 |
| 2,530,829 | * | 11/1950 | Licht | 2/42 |
| 2,595,088 | * | 4/1952 | Licht | 2/260 |
| 2,649,586 | * | 8/1953 | Josephson | 2/42 |
| 2,923,300 | | 2/1960 | Ots | 128/469 |
| 3,114,374 | | 12/1963 | Chalfin et al. | 128/465 |
| 3,209,756 | | 10/1965 | Rowell . | |
| 3,763,865 | * | 10/1973 | DeFru | 128/465 |
| 4,153,062 | * | 5/1979 | Delet | 128/476 |
| 4,235,240 | | 11/1980 | Cousins | 128/476 |
| 5,141,470 | | 8/1992 | Morgan et al. | 450/52 |
| 5,387,150 | * | 2/1995 | Terrell | 450/41 |
| 5,730,640 | * | 3/1998 | Aex et al. | 450/41 |
| 6,053,800 | * | 4/2000 | Lattanzi | 450/41 |

FOREIGN PATENT DOCUMENTS

| | | |
|---|---|---|
| 76647 | 8/1894 | (DE) . |
| 1048542 | 1/1959 | (DE) . |
| 2061711 | 10/1971 | (DE) . |
| 2737415 | 2/1979 | (DE) . |
| 2750911 | 5/1979 | (DE) . |
| 2902065 | 11/1979 | (DE) . |
| 1194481 | 5/1959 | (FR) . |
| 1254250 | 11/1971 | (GB) . |
| WO 95/18553 | 7/1995 | (WO) . |
| WO 95/19114 | 7/1995 | (WO) . |

* cited by examiner

*Primary Examiner*—John J. Calvert
*Assistant Examiner*—Alissa L. Hoey
(74) *Attorney, Agent, or Firm*—Rosenthal & Osha, L.L.P.

(57) ABSTRACT

The invention relates to a shaping insert (1) for garments for supporting a woman's bust. The aim of the invention is to provide as much bend resistance as possible in the plane stressed by the insert and as much flexibility as possible in relation to bending stresses perpendicular thereto. At the same time, the insert should be as economical as possible to produce. To this end, the insert is configured with at least two insert elements (2, 3) which are arranged essentially one behind the other in the direction perpendicular to the plane which is stressed by the insert. The two insert elements are curved essentially identically either side of the bottom of the insert.

20 Claims, 2 Drawing Sheets

SHAPING FRAME

I. APPLICATION AREA

Figure 1:
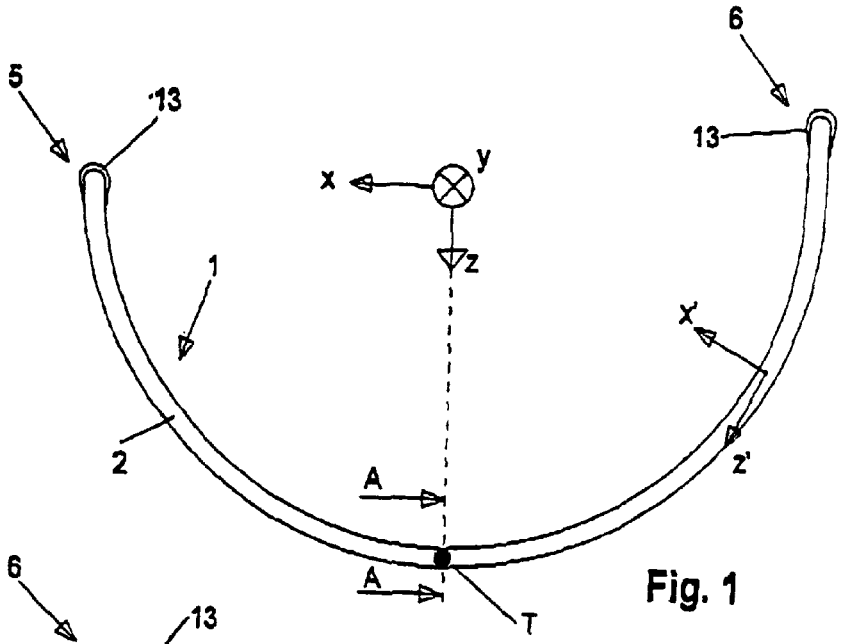

The invention relates to a shaping frame which is intended for items of clothing supporting a woman's bust, and to an item of clothing for supporting a woman's bust.

II. TECHNICAL BACKGROUND

Such shaping frame usually consist of bent wire and are worked into the cups of corsetry, e.g. of bras, bikini tops, bustiers, etc. They retain the fabric of the corsetry in a dimensionally stable manner against the wearer's body even under mechanical loading, e.g. when the wearer is walking, and thus ensure a reliable fit and a well-shaped bust.

In mechanical terms, the shaping frame have to meet various requirements. On the one hand, they are to have the highest possible bending strength in relation to bending resulting from forces which occur in the plane defined by the bent frame (frame plane). On the other hand, they are to be as pliable and/or flexible as possible in relation to bending resulting from forces acting perpendicularly to the frame plane. Finally, a further requirement is to ensure the highest possible level of wearing comfort, i.e. to fulfil the two abovementioned requirements without the wearer having an unpleasant pressing or pinching feeling.

The round-wire shaping frames known from the prior art do not fully satisfy these requirements since they have a relatively high level of rigidity in the direction perpendicular to the frame plane. The likewise known shaping frames which consist of flat-rolled round wire and have a rectangular cross section, of which the long cross-sectional axis is located in the frame plane, fulfil the requirements to better effect since they are more pliable in the direction perpendicular to the frame plane than the shaping frames with a round cross section. If the width of these shaping frames is designed to be as small as possible in the direction perpendicular to the frame plane, in order to increase the flexibility in this direction, then, to counter this, the height of the rectangular cross section, located in the frame plane, has to be increased. This adversely affects, on the one hand, the wearing comfort and, on the other hand, the geometry of the ends of the shaping frames, which are relatively high in relation to their width, with the result that the operation of rounding off their sharp edges in order to protect the fabric of the item of clothing can only be carried out with relatively high outlay.

WO 95/19114 discloses a shaping frame with an I-shaped or bone-shaped cross section. There is also the problem here that it is not possible to reduce as desired the width of the cross section perpendicularly to the frame plane in order to achieve the highest possible level of flexibility in this direction.

DE-B 1 048 542 describes a stiffening frame for bras which has a C-shaped cross section. The C-profile of this known stiffening frame is arranged such that the frame plane runs essentially transversely through the central region of the C-curve. This results in a relatively high level of rigidity in the direction perpendicular to the frame plane, and this is increased further in that the C-profile is reinforced, in those regions of the stiffening frame which are subjected to particular loading, by means of a metal coating arranged in the cavity enclosed by the C-profile.

Furthermore, DE-A 29 02 065 discloses a supporting-wire arrangement which is intended for a bra and is made up of a relatively rigid U-shaped element and of a less rigid extension element. The two elements are arranged one behind the other in the direction perpendicular to the frame plane and are fixedly connected to one another along their congruent regions and at a plurality of locations by spot welding. This increases the rigidity in the congruent regions in the direction perpendicular to the frame plane.

The doubled corset reinforcement described in German Patent 76647 is made up of two spring-steel rods which are located one upon the other and are retained on one another such that they can be displaced with respect to one another in the event of loading in the longitudinal direction.

Finally, the prior art discloses shaping frame which are made of so-called memory metals and ensure excellent flexibility in the direction perpendicular to the frame plane. However, these frames also have a considerably lower level of rigidity in the frame plane and, moreover, memory metals cost so much as to preclude cost-effective production of shaping frame using these materials.

III. DESCRIPTION OF THE INVENTION a) Technical Object

The object of the present invention is thus to provide a shaping frame which is intended for items of clothing supporting a woman's bust, and an item of clothing for supporting a woman's bust, said frame and item of clothing ensuring the highest possible level of rigidity in the frame plane and the highest possible level of flexibility in the direction perpendicular to the frame plane and, at the same time, being capable of being produced as cost-effectively as possible.

b) Achieving the Object

This object is achieved by means of a shaping frame and of an item of clothing according to claims 1 and 19, respectively. Further configurations of the invention can be gathered from the subcdaims.

The invention proposes to configure a shaping frame, which is intended for items of clothing supporting a woman's bust, such that the frame comprises at least two frame elements which are arranged essentially one behind the other in the direction perpendicular to the plane defined by the frame, the so-called frame plane, the frame elements having essentially the same curvature on either side of the lowest point of the frame. The separating surface located between the frame elements is located essentially in the frame plane. "Essentially" in this context means that, rather than the separating surface having to be located absolutely mathematically precisely in the frame plane, it is also possible for it to be slightly inclined in relation to the frame plane or to assume the form of a curved surface, e.g. in the case of a C-shaped separating surface. The frame elements preferably butt against one another, but may also be spaced apart from one another, that is to say may form a narrow interspace in the form of a parting joint between them.

In contrast to a shaping frame made of memory metal, the shaping frame according to the invention may be produced relatively cost-effectively from wire or plastic, has a higher level of dimensional stability than the frame made of memory metal and, in relation to the known shaping frames consisting of wire, has the advantage that, with a comparatively high level of rigidity in the frame plane, ensures a high level of flexibility in the direction perpendicular to the frame plane. In particular, the relatively frequently occurring breakages of the known wire frames on account of the bending loading in the frame plane occur less frequently since the shaping frame according to the invention, on the one hand, easily bends out in the direction perpendicular to the frame plane in the case of excessive bending loading in the frame plane, and the high bending stressing of purely bending loading is reduced by bending/torsional loading being caused at the same time, and, on the other hand, along with the same level of flexibility in the direction perpendicular to the frame plane, it is possible to select a larger overall cross section.

If required, it is also possible to position three or more frame elements in layers. This may be desirable, for example, when the rigidity in the frame plane is increased further and, at the same time, the flexibility in the direction perpendicular to the frame plane is not to be adversely affected, which would be the case if there were an increase in merely the width of a two frame elements in the direction perpendicular to the frame plane. If more than two frame elements are used, then the planes of the in this case at least two separating surfaces are located in an essentially parallel, offset arrangement in relation to the central frame plane.

The at least two frame elements are preferably fixed on one another at their two ends such that relative movement between the frame elements is not possible in the region of the ends. In all the other regions, in which the frame elements merely butt loosely against one another or are spaced apart from one another, relative movement of the frame elements in relation to one another is possible. The selection of the position and of the number of fastening points can influence the extent of the possible relative movement of the frame elements in relation to one another, as result of which it is possible to adjust the behaviour of the shaping frame under mechanical loading. For example, the fastening may be provided exclusively in the region of the most pronounced curvature of the frame elements or may be distributed to a plurality of locations over the length of the frame elements.

If two frame elements are provided, then these may also be connected integrally to one another by being produced by bending a circularly or elliptically continuous wire to give a U-shaped shaping frame. The frame elements therefore need not necessarily be separate from one another.

The overall cross section of the shaping frame according to the invention, essentially comprising the sum of the individual cross sections of the frame elements, preferably has a long cross-sectional axis and a short crosssectional axis, the long cross-sectional axis being located essentially in the frame plane. The overall cross section may be, for example, rectangular, elliptical, C-shaped or I-shaped. However, a circular overall cross section is also conceivable since such a cross section, with the configuration according to the invention, also effects the desired increase in flexibility in the direction perpendicular to the frame plane.

For cost reasons, the individual, layered frame elements are preferably of identical design. This means that they have identical cross sections, identical curvature and identical lengths. This also means that, with precisely two frame elements and a planar separating surface, the latter forms the plane of symmetry of the overall cross section.

However, it is also possible for the separating surface of the frame elements to be located outside the plane of symmetry of the overall cross section if this is necessary for adjusting certain mechanical properties of the shaping frame. Furthermore, it is also possible for the frame elements to be of different lengths, with the result that it is only that region of the shaping frame which is subjected to higher bending loading which comprises a plurality of frame elements.

For the case where the frame elements of the shaping frame according to the invention are produced from wire, they may each be provided with a plastic wire-protecting coating. Alternatively, it is also possible for the frame elements to be arranged in a common, elastic sheath, with the result that the construction from a plurality of frame elements cannot be seen from the outside. In the last-mentioned case, a lubricant may be introduced into the separating surface between the frame elements in order that the relative movement of the frame elements in relation to one another under mechanical loading of the shaping frame is not inhibited to too pronounced an extent.

If the frame elements are not fastened on one another or retained on one another by specifically provided retaining or guide devices, then this function is performed by the frame channel which is provided on the item of clothing for supporting a woman's bust and which is intended for receiving the shaping frame according to the invention and/or by a material frame strip into which the shaping frame is pushed. Should it be desired, however, for the frame elements to be retained on one another, then it is possible to provide a rivet-like guide with play, which allows relative movement of the frame elements in relation to one another in the frame plane.

The frame elements may be produced from a suitable metal or a metal alloy or from non-reinforced or reinforced plastic, in particular glass-fibrereinforced plastic. Examples of possible plastics are, in particular, polyamide, polyacetal (POM) or polyester.

c) Exemplary Embodiments

Figure 2:
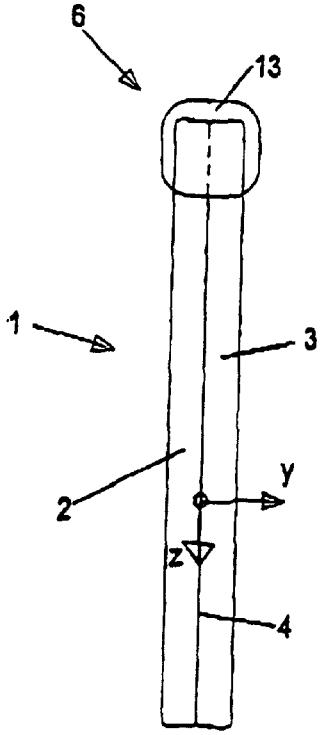
Figure 3:
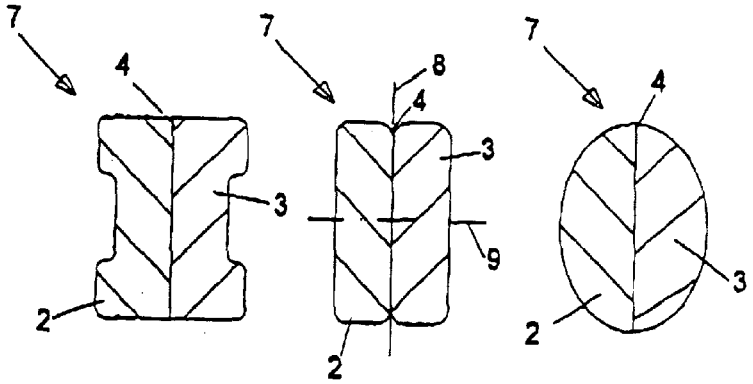
Figure 4:
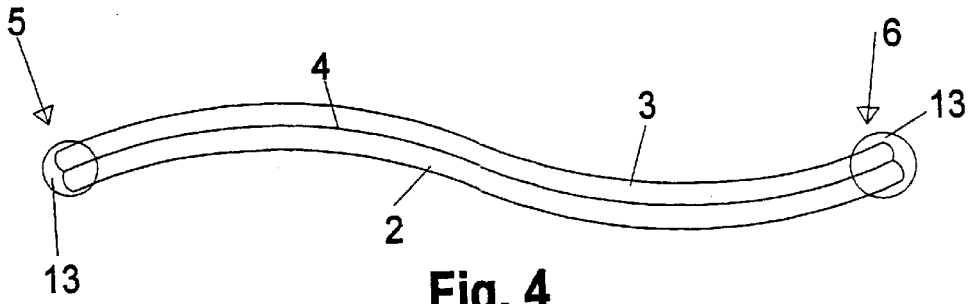
Figure 5:
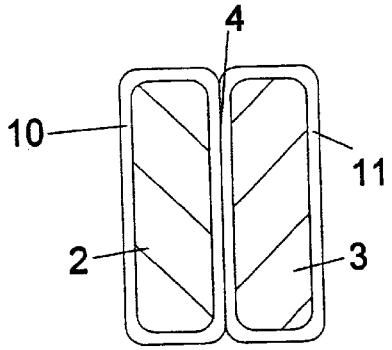
Figure 6:
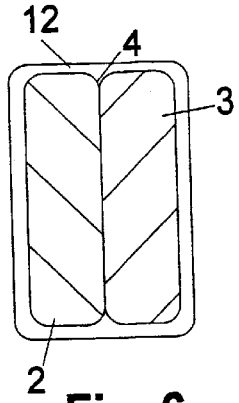
Figure 7:
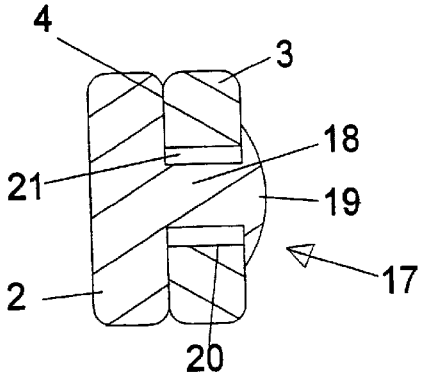
Fig. 7 PRIOR ART
Figure 8:
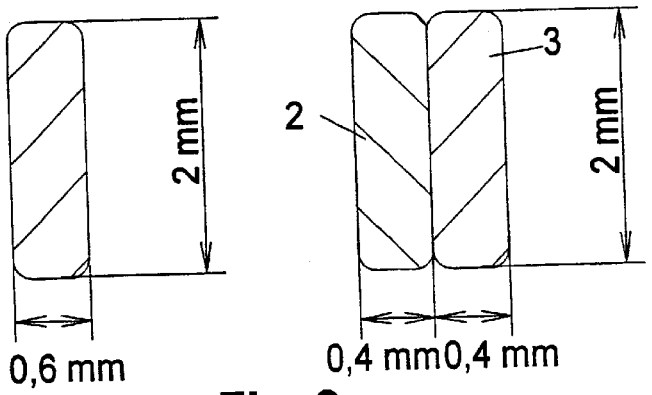

A number of embodiments of a shaping frame according to the invention are described hereinbelow with reference to the drawings, in which:

FIG. 1 shows a view of a shaping frame according to the invention,

FIG. 2 shows a side view of the shaping frame according to FIG. 1 from the right, FIG. 3 shows a number of possible overall and/or individual cross sections, along section A—A in FIG. 1, of shaping frames or frame elements according to the invention, FIG. 4 shows a view of the shaping frame according to FIG. 1 from above, the frame shape which is established in the case of relatively large bending forces in the frame plane being illustrated in exaggerated form, FIG. 5 shows an overall cross section, of a shaping frame according to the invention, in which the coating of the frame elements is shown, FIG. 6 shows an overall cross section, of a shaping frame according to the invention, in which the common sheath of the frame elements is shown, FIG. 7 shows an overall cross section, of a shaping frame according to the invention, in which a rivet-like guide with play is shown, and FIG. 8 shows a comparison example between a shaping frame according to the prior art (cross section shown on the left) and a shaping frame according to the invention (cross section shown on the right).

FIG. 1 shows a view of a shaping frame according to the invention. The frame 1 comprises two essentially identical, abutting frame elements 2 and 3 which are arranged one behind the other in the y-direction, which can be seen in FIG. 2. In particular, the frame elements 2, 3 thus have essentially the same or identical curvature on either side of the lowest point T which is indicated in FIG. 1, constitutes the point where the frame 1 passes through the y,z-plane and indicates the lowest point of the frame 1 in the z-direction. This means that those sections of the frame elements 2, 3 which are located in each case on the same side of the lowest point T are located essentially congruently one behind the other in the y-direction.

The shaping frame shown in FIG. 1 is the frame provided for the righthand cup of a bra, bikini top, bustier, corset, body, etc. This can be seen by the fact that the essentially U-shaped frame 1, rather than being of a precise symmetrical U-shape, has the frame half which is on the right-hand side in FIG. 1 projecting further upwards than the left-hand frame half. This means that the left-hand end 5 of the frame 1 does not project too far into the wearer's chest.

The two frame elements 2, 3 consist of flat-rolled round wire or flat springsteel wire and are fixed on one another at their two ends 5, 6 in each case by means of a cap 13 which rounds off the sharp edges. The caps 13 are preferably produced by a droplet of plastic being applied to the ends 5, 6, and they prevent the frame elements 2, 3 from moving relative to one another in the region of their ends 5, 6. The ends 5, 6 may also be connected in some other manner, e.g. by adhesive bonding, welding, mechanical fastening and the like.

In the case of the embodiment shown, the separating surface 4 located between the two frame elements 2, 3 lies in the x,z-plane, which is referred to as the frame plane hereinbelow. Outside the caps 13, the frame elements 2, 3 merely butt against one another and can move relative to one another under bending and/or torsional loading.

FIG. 3 shows three examples of overall cross sections 7 of the frame 1, along section A—A in FIG. 1, which can be used according to the invention. In this case, the overall cross sections 7 are a rectangular cross section, an I-shaped cross section and an elliptical cross section, and the individual cross sections of the frame elements 2, 3 are rectangular cross sections, halved I-shaped cross sections and halved elliptical cross sections. In order to achieve the highest possible level of rigidity in relation to bending about the y-axis, the long overall cross-sectional axis 8 is arranged in the frame plane x,z, while the short overall cross-sectional axis 9 runs in the direction perpendicular to the frame plane x,z, as is shown in the case of the rectangular cross section. This also achieves a low level of rigidity in relation to bending moments about the local x'-axis of the coordinate system indicated by prime strokes. In the case of all the overall cross sections 7 shown in FIG. 3, the separating surface 4 forms the plane of symmetry.

FIG. 4 shows, in a view of the shaping frame according to FIG. 1 from above, how the shaping frame according to the invention with a rectangular cross section shown in FIG. 3 behaves in the case of relatively large bending moments which act about the y-axis and force the ends 5, 6 apart. In the case of such loading, the shaping frame according to the invention bends out in the y-direction, that is to say perpendicularly to the frame plane x,z, into an S-shaped position, which is illustrated in exaggerated form, with result that, rather than purely bending loading, a mix of bending/torsional loading prevails in the frame 1.

FIG. 5 shows an overall cross section 7, along section A—A in FIG. 1, in which it can be seen that the frame elements 2, 3, which have a rectangular individual cross section, are each provided with a coating 10, 11, which preferably consists of plastic, e.g. polyamide.

FIG. 6 shows an alternative embodiment of the overall cross section 7, along section A—A in FIG. 1, in which the two frame elements 2, 3 are arranged within a common sheath 12. In order that the frame elements 2, 3 can move relative to one another to a sufficient extent in the frame plane x,z in this embodiment as well, it is possible for the sheath 12 to consist of a flexible plastic and for a suitable lubricant to be introduced into the separating surface 4 between the frame elements 2, 3.

FIG. 7 shows a further possible way of securing the frame elements 2, 3 on one another. In this case, the frame 2 has at least two mushroom-like or rivet-like protrusions 17 which comprise a shank 18 and a rounded-off head 19. An annular space is produced between the frame element 2 and the exposed annular surface of the head 19, said annular surface being oriented towards the left in FIG. 7, and the frame element 3 can engage in said annular space, the bore 20 located in the frame element 3 having a diameter which allows sufficient play 21 for a relative movement of the frame elements 2, 3 in the frame plane. It is also the case that the length of the shank 18 or the distance between the separating surface 4 and that annular surface of the head 19 which acts on the frame element 3 is dimensioned such that a relative movement of the frame elements 2, 3 in the frame plane x,z is not obstructed. In order that the wearing comfort of the frame according to this embodiment is not adversely affected, said frame is to be worked into the relevant item of clothing such that the heads 19 are oriented away from the wearer's body.

The shaping frame according to the invention may also be designed without the caps 13 at the ends 5, 6, said caps fixing the frame elements 2, 3 on one another. In this case, the shaping frames according to FIGS. 6 and 7 can be displaced in relation to one another in the local z'-direction without being capable of being released from one another in the y-direction. In this case, the embodiments according to FIGS. 3 and 5 have to be held together by the frame channel provided in the relevant item of clothing. In order to prevent the material or fabric of the item of clothing from being damaged in the case of all the embodiments shown, it is possible to fasten, either at the two ends of the frame element 2 or at the two ends of the frame element 3, a protective cap which provides sufficient space beyond the respective frame end in order for the adjacent end of the frame element 3 or 2 to be received in a displaceable manner. This ensures that, despite the capacity for unobstructed relative movement in the z'-direction, the item of clothing is not damaged.

FIG. 8 shows a comparison of a shaping frame according to the prior art and a shaping frame according to the invention. The shaping frame according to the prior art, which consists of flat-rolled round wire, has the rectangular cross section which is illustrated on the left and has the dimensions 0.6 mm×2 mm. The shaping frame according to the invention has the likewise rectangular overall cross section which is illustrated on the right and is made up of the two identical rectangular individual cross sections of the frame elements 2, 3. The rectangular cross section of each frame element 2, 3 has the dimensions 0.4 mm×2 mm.

It can be gathered from the dimensions of the overall cross sections which are to be compared that the use of material in the shaping frame according to the invention is 33.3% higher than in the known shaping frame. Since the breaking load under bending loading in the frame plane x,z is proportional to the material width in the y-direction, the shaping frame according to the invention has a breaking load which is higher by 33.3%, which is desirable according to the invention. The same applies to the bending in the frame plane x,z, with the result that the dimensional stability in the frame plane x,z is 33.3% higher, which is likewise desirable according to the invention.

If a force of the same magnitude acts on the two shaping frames in the direction perpendicular to the frame plane x,z, this results in the level of bending of the shaping frame according to the invention being greater by 68% than the level of bending of the shaping frame according to the prior art. This means that, despite the larger overall cross section of the shaping frame according to the invention, the level of flexibility in the direction perpendicular to the frame plane x,z is higher by 68% than that of the known shaping frame, which is desirable according to the invention.

What is claimed is:

1. A shaping frame which is intended for items of clothing supporting a woman's bust comprising:

at least two frame elements arranged essentially one behind the other in a direction perpendicular to a plane defined by the frame, wherein the frame elements have essentially the same curvature on either side of the lowest point of the frame over a substantial section of the frame.

2. Shaping frame according to claim 1, wherein the frame elements are fastened on one another at least at one of their ends.

3. Shaping frame according to claim 2, wherein the fastening is effected by a cap which rounds off at least one end.

4. Shaping frame according to one of claims 1, wherein the frame elements are fastened on one another in the region of their most pronounced curvature.

5. Shaping frame according to claim 1, wherein the overall cross section of the frame has a long axis and a short axis, the long axis being located essentially in the plane defined by the frame.

6. Shaping frame according to claim 5, wherein the overall cross section is a rectangular cross section.

7. Shaping frame according to claim 5, wherein the overall cross section is an I-shaped cross section.

8. Shaping frame according to claim 5, wherein the overall cross section is an elliptical cross section.

9. Shaping frame according to claim 1, wherein the frame elements are fastened on one another at a plurality of locations distributed over their length.

10. Shaping frame according to claim 1, wherein the separating surface located between the frame elements is planar.

11. Shaping frame according to claim 1, wherein the frame elements each have a coating.

12. Shaping frame according to claim 1, wherein the coating is made of plastic.

13. Shaping frame according to claim 1, wherein the frame elements are arranged within a common sheath.

14. Shaping frame according to claim 13, wherein the sheath is made of plastic.

15. Shaping frame according to claim 1, wherein the frame elements are made of metal.

16. Shaping frame according to claim 1, wherein the frame elements are made of plastic.

17. Shaping frame according to claim 1, wherein the frame is worked into at least one cup.

18. A shaping frame intended for items of clothing supporting a woman's bust comprising:

at least two frame elements arranged essentially one behind the other in a direction perpendicular to a plane defined by the frame, wherein the frame elements have essentially the same curvature; and a planar separating surface disposed between the frame elements, wherein the separating surface forms a plane of symmetry with respect to the overall cross section of the frame.

19. A shaping frame intended for items of clothing supporting a woman's bust comprising:

at least two frame elements arranged essentially one behind the other in a direction perpendicular to a plane defined by the frame, wherein the frame elements have essentially the same curvature on either side of the lowest point of the frame, the frame elements being guided on one another by a rivet-like guide device with play.

20. A shaping frame intended for items of clothing supporting a woman's bust comprising:

at least two frame elements arranged essentially one behind the other in a direction perpendicular to a plane defined by the frame, wherein the frame elements have essentially the same curvature on either side of the lowest point of the frame;

a sheath containing the frame elements; and a separating surface disposed between the frame elements, the separating surface having a lubricant located therein.

* * * * *